US005891267A

United States Patent [19]

Schaeffer et al.

[11] Patent Number: 5,891,267

[45] Date of Patent: Apr. 6, 1999

[54] THERMAL BARRIER COATING SYSTEM AND METHOD THEREFOR

[75] Inventors: Jon C. Schaeffer, Milford, Ohio; Kevin S. O'Hara, Boxford, Mass.

[73] Assignee: General Electric Company, Cincinnati, Ohio

[21] Appl. No.: 783,335

[22] Filed: Jan. 16, 1997

[51] Int. Cl.[6] ..... C23C 8/10; C23C 8/20; C23C 8/80

[52] U.S. Cl. ..... 148/206; 148/537

[58] Field of Search ..... 428/610, 627, 428/678, 668, 679, 629, 623; 148/206, 537, 316, 225, 277, 278, 285; 427/419.3, 328

[56] References Cited

U.S. PATENT DOCUMENTS

| | | | |
|---|---|---|---|
| Re. 33,876 | 4/1992 | Goward et al. | 428/633 |
| 3,655,458 | 4/1972 | Reichman | 148/126 |
| 4,237,193 | 12/1980 | Jackson et al. | 428/678 |
| 4,248,940 | 2/1981 | Goward et al. | 428/633 |
| 4,321,311 | 3/1982 | Strangman | 428/623 |
| 4,676,994 | 6/1987 | Demaray | 427/42 |
| 5,194,219 | 3/1993 | Baldi | 419/37 |
| 5,334,263 | 8/1994 | Schaeffer | 148/217 |
| 5,598,968 | 2/1997 | Schaeffer et al. | 148/534 |

*Primary Examiner*—John J. Zimmerman
*Attorney, Agent, or Firm*—Andrew C. Hess; David L. Narciso

[57] ABSTRACT

A thermal barrier coating system and a method for forming the coating system on an article designed for use in a hostile thermal environment, such as superalloy turbine, combustor and augmentor components of a gas turbine engine. The coating system includes a carburized zone at the surface of a component on which a thermal barrier coating system is to be formed. An aluminum-rich bond coat is then formed on the carburized surface, followed by oxidation of the bond coat to form an aluminum oxide layer. A thermal insulating ceramic layer is then formed on the oxide layer, so as to be chemically bonded thereto. According to the invention, appropriately carburizing the surface of a component serves to form carbides that tie up refractory metals present in the underlying superalloy substrate of the component, and thereby prevents the detrimental effects of these metals on the bond coat-oxide layer interface. The benefit of the carburized zone is particularly notable where the component is a superalloy containing relatively high levels of one or more refractory metals, such as tantalum, tungsten, molybdenum, rhenium, titanium, chromium, hafnium and zirconium.

6 Claims, 1 Drawing Sheet

THERMAL BARRIER COATING SYSTEM AND METHOD THEREFOR

This invention relates to thermal barrier coating systems for components exposed to high temperatures, such as the hostile thermal environment of a gas turbine engine. More particularly, this invention is directed to a thermal barrier coating system that incorporates a carburized region beneath an aluminum-rich bond coat on which a thermal insulating ceramic layer is deposited.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys, though such alloys alone often do not retain adequate mechanical properties for components located in certain sections of a gas turbine engine, such as the turbine, combustor and augmentor. A common solution is to thermally insulate such components in order to minimize their service temperatures. For this purpose, thermal barrier coatings (TBC) formed on the exposed surfaces of high temperature components have found wide use.

To be effective, thermal barrier coatings must have low thermal conductivity, strongly adhere to the article, and remain adherent throughout many heating and cooling cycles. The latter requirement is particularly demanding due to the different coefficients of thermal expansion between materials having low thermal conductivity and superalloy materials typically used to form turbine engine components. Thermal barrier coating systems capable of satisfying the above requirements have generally required a metallic bond coat deposited on the component surface, followed by an adherent ceramic layer that serves to thermally insulate the component. In order to promote the adhesion of the ceramic layer to the component and inhibit oxidation of the underlying superalloy, the bond coat is typically formed from an oxidation-resistant aluminum-containing alloy such as MCrAlY (where M is iron, cobalt and/or nickel), or by an oxidation-resistant aluminum-based intermetallic such as nickel aluminide or platinum aluminide.

Various ceramic materials have been employed as the ceramic layer, particularly zirconia ($ZrO_2$) stabilized by yttria ($Y_2O_3$), magnesia (MgO), ceria ($CeO_2$), scandia ($Sc_2O_3$), or another oxide. These particular materials are widely employed in the art because they can be readily deposited by plasma spray, flame spray and vapor deposition techniques, and are reflective to infrared radiation so as to minimize the absorption of radiated heat. In order to increase the resistance of the ceramic layer to spallation when subjected to thermal cycling, the prior art has proposed ceramic layers having enhanced strain tolerance as a result of the presence of porosity, microcracks and segmentation of the ceramic layer. Thermal barrier coating systems employed in higher temperature regions of a gas turbine engine are typically deposited by physical vapor deposition (PVD) techniques that yield a columnar grain structure that is able to expand without causing damaging stresses that lead to spallation.

The bond coat is also critical to promoting the spallation resistance of a thermal barrier coating system. As noted above, bond coats provide an oxidation barrier for the underlying superalloy substrate. Conventional bond coat materials contain aluminum, such as diffusion aluminides and MCrAlY alloys noted above, which enables such bond coats to be oxidized to grow a strong adherent and continuous aluminum oxide layer (alumina scale). The oxide layer chemically bonds the ceramic layer to the bond coat, and protects the bond coat and the underlying substrate from oxidation and hot corrosion.

Though bond coat materials are particularly alloyed to be oxidation-resistant, oxidation inherently occurs over time at elevated temperatures, which gradually depletes aluminum from the bond coat. In addition, aluminum is lost from the bond coat as a result of diffusion into the superalloy substrate. Eventually, the level of aluminum within the bond coat is sufficiently depleted to prevent further growth of aluminum oxide, at which time spallation may occur at the interface between the bond coat and the oxide layer. In addition to depletion of aluminum, the ability of the bond coat to form the desired aluminum oxide layer can be hampered by the diffusion of elements from the superalloy into the bond coat, such as during formation of a diffusion aluminide coating or during high temperature exposure. Oxidation of such elements within the bond coat can become favored as the aluminum within the bond coat is depleted through oxidation and interdiffusion.

From the above, it is apparent that the service life of a thermal barrier coating is dependent on the bond coat used to anchor the thermal insulating ceramic layer, which is prone to degradation over time at elevated temperatures as a result of depletion of aluminum and interdiffusion with the superalloy substrate. Once spallation of the ceramic layer has occurred, the component must be refurbished or scrapped at considerable cost. Therefore, it would be desirable if further improvements were possible for the service life of a thermal barrier coating system.

SUMMARY OF THE INVENTION

It is an object of this invention to provide an improved thermal barrier coating system and process for an article designed for use in a hostile thermal environment, such as superalloy components of a gas turbine engine.

It is another object of this invention that the coating system includes an aluminum-rich bond coat that is formed on the surface of the article, and a thermal insulating ceramic layer overlying the bond coat.

It is a further object of this invention that the coating system inhibits diffusion of elements from the article into the bond coat.

It is yet another object of this invention that the coating system includes a carburized zone at the surface of the article, wherein carbides of refractory metals are formed at the surface such that the refractory metals are inhibited from diffusing into the bond coat from the article.

The present invention generally provides a thermal barrier coating system and a method for forming the coating system on an article designed for use in a hostile thermal environment, such as superalloy turbine, combustor and augmentor components of a gas turbine engine. The method is particularly directed to increasing the spallation resistance of a thermal barrier coating system that includes a thermal insulating ceramic layer.

According to this invention, in addition to the depletion of aluminum, the ability of an aluminum-rich bond coat to form and maintain an aluminum oxide layer on its surface can be hampered by the diffusion of refractory metals from a superalloy substrate into the bond coat. Refractory metals that have diffused into the bond coat slow down aluminum diffusion and increase the aluminum oxide growth rate. As aluminum is depleted from the bond coat by oxidation, refractory metals such as tantalum, tungsten, molybdenum, rhenium, zirconium, chromium, titanium and hafnium are liable to diffuse through the bond coat to the bond coat surface, where they rapidly form voluminous and nonadherent oxides that are deleterious to the bond coat and to the adhesion of the ceramic layer. Certain single-crystal superalloys are particularly susceptible to diffusion of refractory metals into the bond coat as a result of their relatively higher content of refractory metals.

On the basis of the above, the thermal barrier coating system of this invention includes a carburized zone at the surface of the component on which a thermal barrier coating system is to be formed. A suitable aluminum-rich bond coat is then formed on the carburized surface, followed by oxidation of the bond coat to form an aluminum oxide layer. A thermal insulating ceramic layer is then formed on the oxide layer, so as to be chemically bonded thereto. According to this invention, appropriately carburizing the surface of a component serves to form carbides that tie up refractory metals present in the underlying superalloy substrate of the component. The benefit of the carburized zone is particularly notable where the component is a superalloy containing relatively high levels, e.g., two weight percent or more, of one or more refractory metals, such as tantalum, tungsten, molybdenum, rhenium, titanium, chromium, hafnium and zirconium.

According to this invention, the carburizing process must be carried out to yield a carburized zone whose thickness is up to about 100 micrometers, preferably on the order of about 25 to about 50 micrometers in thickness. In addition, the carburized zone preferably contains about 25 to about 75 volume percent carbides of one or more refractory metals. A thermal barrier coating system formed in accordance with the above is capable of exhibiting enhanced spallation resistance, and therefore a longer service life of as much as much as five times longer than conventional thermal barrier coating systems.

In addition to advantageously tying up carbides of refractory metals, the carburized surface provided by this invention lowers the coefficient of thermal expansion of the component substrate, so as to be closer to that of the ceramic layer of the coating system. As such, the carburized surface of the component is more compatible with the ceramic layer as a result of lower thermal-induced stresses. Finally, carburizing of the component surface forms submicron carbide precipitates at the surface, which trap sulfur and other deleterious tramp elements. As a result, these elements are prevented from segregating to the bond coat-oxide scale interface where they would have a deleterious effect on adhesion of the ceramic layer.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE INVENTION

Figure 1:
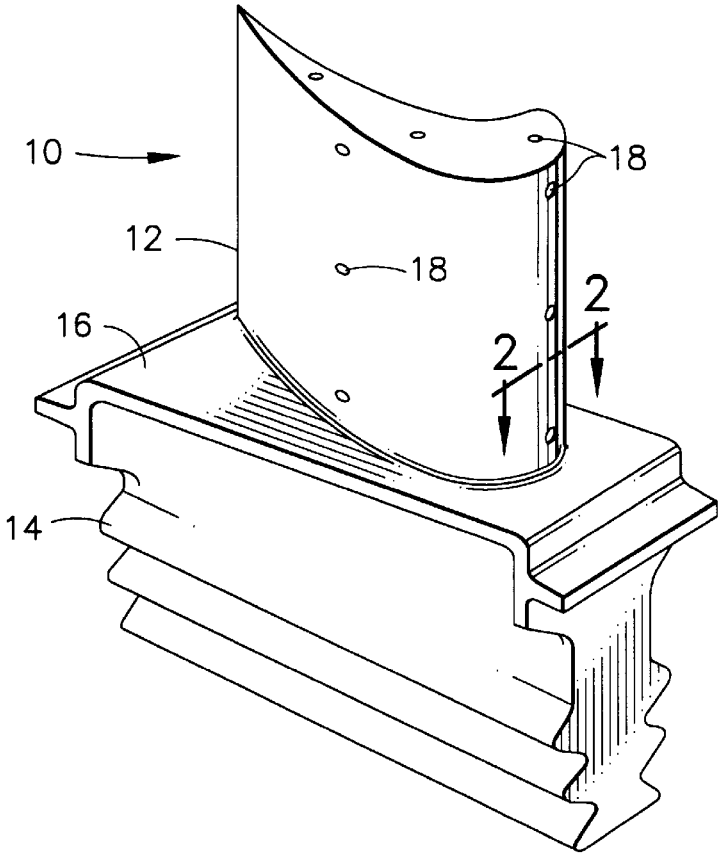
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe attack by oxidation, corrosion and erosion. The airfoil 12 is anchored to a turbine disk (not shown) with a dovetail 14 formed on a root section 16 of the blade 10. Cooling passages 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which an environmental coating may be used to protect the component from its environment.

Figure 2:
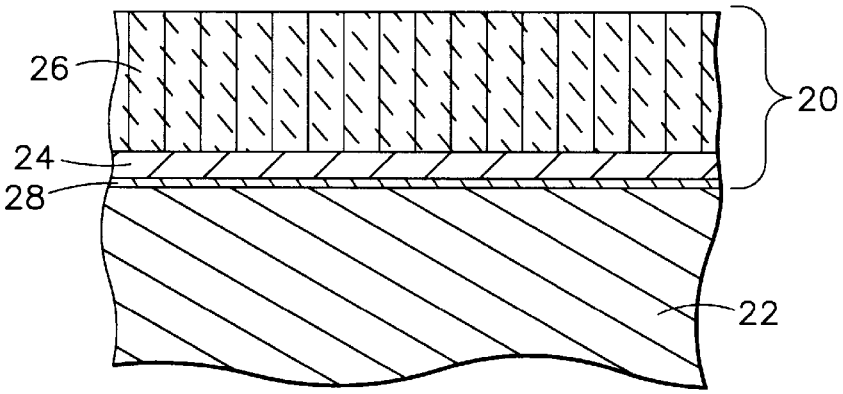
FIG. 2 is a cross-sectional view of the blade of FIG. 1 along line 2—2, and shows a thermal barrier coating on the blade in accordance with this invention.

Represented in FIG. 2 is a thermal barrier coating system 20 in accordance with this invention. As shown, the coating system 20 includes a bond coat 24 overlying a substrate 22, which is typically the base material of the blade 10. According to the invention, suitable materials for the substrate 22 (and therefore the blade 10) include equiaxed, directionally-solidified and single-crystal nickel and cobalt-base superalloys, with the invention being particularly advantageous for single-crystal superalloys that contain one or more refractory metals. A notable example is a single-crystal nickel-base superalloy known as Rene N5, disclosed in copending U.S. patent application Ser. No. 08/270,528, assigned to the assignee of this invention. This superalloy nominally contains, in weight percent, about 7% chromium, about 1.5% molybdenum, about 5% tungsten, about 3% rhenium, about 6.5% tantalum and about 0.15% hafnium, in addition to various other important alloying constituents. This invention is particularly advantageous for superalloys that contain relatively low levels of carbon, e.g., 0.5 weight percent or less, as will be discussed below.

As is typical with thermal barrier coating systems for components of gas turbine engines, the bond coat 24 is an aluminum-rich alloy, such as a diffusion aluminide, a platinum aluminide, or an MCrAlY alloy of a type known in the art. As such, an aluminum oxide scale (not shown) naturally develops on the bond coat 24, and can be more rapidly grown by forced oxidation of the bond coat 24. The oxide scale provides environmental protection for the underlying substrate 22, in that it inhibits further oxidation of the bond coat 24 and substrate 22. As shown, the coating system 20 of this invention also includes a thermal insulating ceramic layer 26 that is chemically bonded to the bond coat 24 with the oxide scale on the surface of the bond coat 24. To obtain a strain-tolerant columnar grain structure, the ceramic layer 26 is preferably deposited by physical vapor deposition using techniques known in the art, though air plasma spray techniques can also be used. A preferred material for the ceramic layer 26 is an yttria-stabilized zirconia (YSZ), a preferred composition being about 6 to about 8 weight percent yttria, though other ceramic materials could be used, such as yttria, nonstabilized zirconia, or zirconia stabilized by magnesia, ceria, scandia or another oxide. The ceramic layer 26 is deposited to a thickness that is sufficient to provide the required thermal protection for the underlying substrate 22 and blade 10, generally on the order of about 75 to about 300 micrometers.

According to this invention, the coating system 20 further includes a carburized zone 28 at the surface of the substrate 22, i.e., the substrate interface with the bond coat 24. The carburized zone 28 serves to tie up refractory metals in the superalloy substrate 22, and therefore renders the bond coat 24 less susceptible to interactions and interdiffusion of elements observed with prior art bond coats and their superalloy substrates. This invention is particularly advantageous for superalloys that contain relatively low levels of carbon, e.g., 0.5 weight percent or less, in that the carburized zone 28 is intended to provide sufficient carbon at the surface of a substrate 22 to ensure that refractory metals are tied up as carbides, e.g., MC, $M_6C$ and $M_{23}C_6$.

In addition to its desirable effect on refractory metals, an important aspect of this invention is to form the carburized zone 28 to contain a sufficient volume of carbides to reduce the coefficient of thermal expansion of the substrate 22 at its interface with the bond coat 24. In doing so, the level of thermally-induced stresses between the substrate 22 and the ceramic layer 26 is reduced or graded, with the result that the coating system 20 is more spall-resistant. Finally, the carburized zone 28 provides an incoherent interface with the bond coat 24, composed of submicron carbide precipitates that trap sulfur and other deleterious tramp elements that would otherwise segregate to the interface between the bond coat 24 and its oxide scale, and there cause or promote spallation of the ceramic layer 26.

According to this invention, the surface of the substrate 22 must be appropriately processed to form a carburized zone 28 that will achieve the above-noted advantages. In particular, the refractory metals are reacted to form carbides that constitute about 25 to about 75 volume percent of the carburized zone 28, and to yield a carburized zone 28 that extends to a depth of at least about 25 micrometers, but preferably not deeper than about 100 micrometers in order to avoid significantly affecting the mechanical properties of the substrate 22. A suitable carburization process begins by grit blasting the substrate 22, such as with 240 grit aluminum oxide particles at about 60 pisg (about 4 bar). The substrate 22 can then be carburized in a standard carburizing furnace using a mixture of hydrogen gas and methane at a ratio of about 1:10 as the carburizing gas, though a mixture of carbon monoxide and carbon dioxide could be used. Contrary to prior art carburizing techniques, such as that typical for steels, the carburization process of this invention is preferably performed at a pressure of less than about 0.5 atmosphere (about 0.5 bar). The substrate 22 is then heated to a temperature of at least about 900° C., at most about 1200° C., and preferably about 1080° C. (about 1975° F.), for a duration of about one to four hours. The substrate 22 is then allowed to cool to room temperature within the carburizing gas atmosphere of the furnace. Upon removal, conventional processing can be performed to form the bond coat 24, oxide scale and ceramic layer 26 of the coating system 20.

Notably, the pressures, temperatures and durations preferred for the carburizing process of this invention differ from that disclosed in U.S. Pat. No. 5,334,263 to Schaeffer, assigned to the assignee of this invention. In addition, the intent of the carburizing process taught by Schaeffer is directed to inhibiting the formation of a secondary reaction zone (SRZ) beneath a diffusion aluminide coating that is employed as an environmental coating without a ceramic thermal barrier coating. Accordingly, the problems confronted and solved by the present invention differ significantly from that of Schaeffer. Finally, the teachings of Schaeffer do not ensure the proper distribution of carbides required to promote the spallation resistance of thermal barrier coating systems of the type disclosed herein and illustrated in FIG. 2. Accordingly, one skilled in the art would not be motivated to apply the teachings of Schaeffer to the subject matter of the present invention.

While our invention has been described in terms of a preferred embodiment, it is apparent that other forms could be adopted by one skilled in the art. Accordingly, the scope of our invention is to be limited only by the following claims.

What is claimed is:

1. A method for forming a thermal barrier coating system on a surface of a component, the method comprising the steps of:

carburizing a surface of the component at a temperature of about 900° C. to about 1200° C. and a pressure of less than about 0.5 atmosphere for a duration of about one to about four hours to produce a carburized zone having a thickness of up to about 100 micrometers and containing about 25 to about 75 volume percent carbides;

forming an aluminum-rich bond coat on the surface;

forming an aluminum oxide layer on the bond coat; and then forming a ceramic layer on the aluminum oxide layer.

2. A method as recited in claim 1, wherein the carburizing step produces a carburized zone characterized by the presence of at least one carbide of a refractory metal.

3. A method as recited in claim 1, wherein the bond coat is a diffusion aluminide alloy.

4. A method as recited in claim 1, wherein the bond coat is an MCrAlY alloy where M is iron, cobalt and/or nickel.

5. A method as recited in claim 1, wherein the component is formed by a superalloy containing at least about two weight percent of at least one refractory metal and 0.5 weight percent or less of carbon.

6. A method as recited in claim 5, wherein the superalloy contains molybdenum, tungsten, rhenium, tantalum, titanium, chromium, hafnium and zirconium.

* * * * *